US008141997B2

(12) United States Patent
Gengrinovich et al.

(10) Patent No.: US 8,141,997 B2
(45) Date of Patent: Mar. 27, 2012

(54) INK SUPPLY SYSTEM

(75) Inventors: Semion Gengrinovich, Ramat Gan (IL); Chen Turkenitz, Ramat Hasharon (IL); Moti Balaish, Netanya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 349 days.

(21) Appl. No.: 12/609,389

(22) Filed: Oct. 30, 2009

(65) Prior Publication Data

US 2011/0102524 A1 May 5, 2011

(51) Int. Cl.
*B41J 2/175* (2006.01)

(52) U.S. Cl. ..... 347/85

(58) Field of Classification Search ..... 347/84, 347/85, 86, 87, 92
See application file for complete search history.

(56) References Cited

U.S. PATENT DOCUMENTS

| | | | | |
|---|---|---|---|---|
| 6,234,621 | B1 | 5/2001 | Musser et al. | |
| 6,312,119 | B1 | 11/2001 | Kocher et al. | |
| 6,457,820 | B1 * | 10/2002 | Cai et al. | 347/92 |
| 7,188,940 | B2 | 3/2007 | Feliciano | |
| 7,344,230 | B2 | 3/2008 | Moynihan | |
| 7,543,921 | B2 | 6/2009 | Byun et al. | |
| 2003/0122907 | A1 | 7/2003 | Kim | |
| 2004/0080590 | A1 | 4/2004 | Jung et al. | |
| 2005/0237367 | A1 | 10/2005 | Hagen et al. | |
| 2007/0052775 | A1 * | 3/2007 | Jung | 347/86 |
| 2007/0052779 | A1 | 3/2007 | Cho | |
| 2007/0292162 | A1 | 12/2007 | Regev et al. | |
| 2008/0036837 | A1 | 2/2008 | Gray et al. | |

* cited by examiner

*Primary Examiner* — Anh T. N. Vo

(57) ABSTRACT

An ink supply system including a reservoir and a foam regulator. The reservoir is configured to hold a volume of ink and configured to be in fluid communication with a fluid ejection structure. The foam regulator is operable in a first state in which the foam regulator permits application of negative pressure through the foam regulator to apply negative pressure to the fluid ejection structure and to the reservoir, and a second state in which the foam regulator blocks passage of ink foam through the foam regulator.

12 Claims, 5 Drawing Sheets

INK SUPPLY SYSTEM

BACKGROUND

Given the ubiquitous use of ink-jet printers, there are many types of ink-jet printing systems and many types of ink. Despite this variety, foaming of ink within the printing systems is common and can be caused differently from system to system. For example, in some systems, the foaming can be caused by surfactants, which are intended to adjust surface tension of the ink. In some instances, while the presence of negative pressure favorably prevents drooling from nozzles of a printhead, this negative pressure also can allow the ink to be mixed under suction with air, thereby producing more foam or bubbles.

Among other issues associated with foaming of ink, in some systems, the foam enters the supply line of the negative pressure source. This phenomenon can foul operation of the negative pressure system and/or harm the supply line because of the aggressive characteristics of the ink on certain materials.

DETAILED DESCRIPTION

In the following detailed description, reference is made to the accompanying drawings which form a part hereof, and in which is shown by way of illustration specific embodiments in which the present general inventive concept may be practiced. In this regard, directional terminology, such as "top," "bottom," "front," "back," "leading," "trailing," etc., is used with reference to the orientation of the Figure(s) being described. Because components of embodiments of the present general inventive concept can be positioned in a number of different orientations, the directional terminology is used for purposes of illustration and is in no way limiting. It is to be understood that other embodiments may be utilized and structural or logical changes may be made without departing from the scope of the present general inventive concept. The following detailed description, therefore, is not to be taken in a limiting sense, and the scope of the present general inventive concept is defined by the appended claims.

Embodiments of the present general inventive concept are directed to systems and methods for preventing uptake of ink foam into a negative pressure pathway from an ink supply pathway of a printhead. In one embodiment, an ink supply system includes a reservoir and a foam regulator. The reservoir is configured to hold a volume of ink and configured to be in fluid communication with a fluid ejection structure. The foam regulator is operable in a first state in which the foam regulator permits application of negative pressure through the foam regulator to apply negative pressure to the fluid ejection structure and to the reservoir, and a second state in which the foam regulator blocks passage of ink foam from the reservoir through the foam regulator. In this way, the foam regulator prevents migration of ink foam into the negative pressure conduit and negative pressure source, thereby preventing cross-contamination of adjacent different colored ink supplies. Moreover, the foam regulator also prevents damage to the negative pressure conduit that might otherwise occur upon entry of the aggressive characteristics of the inks into the negative pressure conduit. Accordingly, the foam regulator contributes to increased longevity of the negative pressure conduit while maintaining color purity among the different color ink supplies.

These embodiments and additional embodiments are described in association with FIGS. 1-5.

Figure 1:
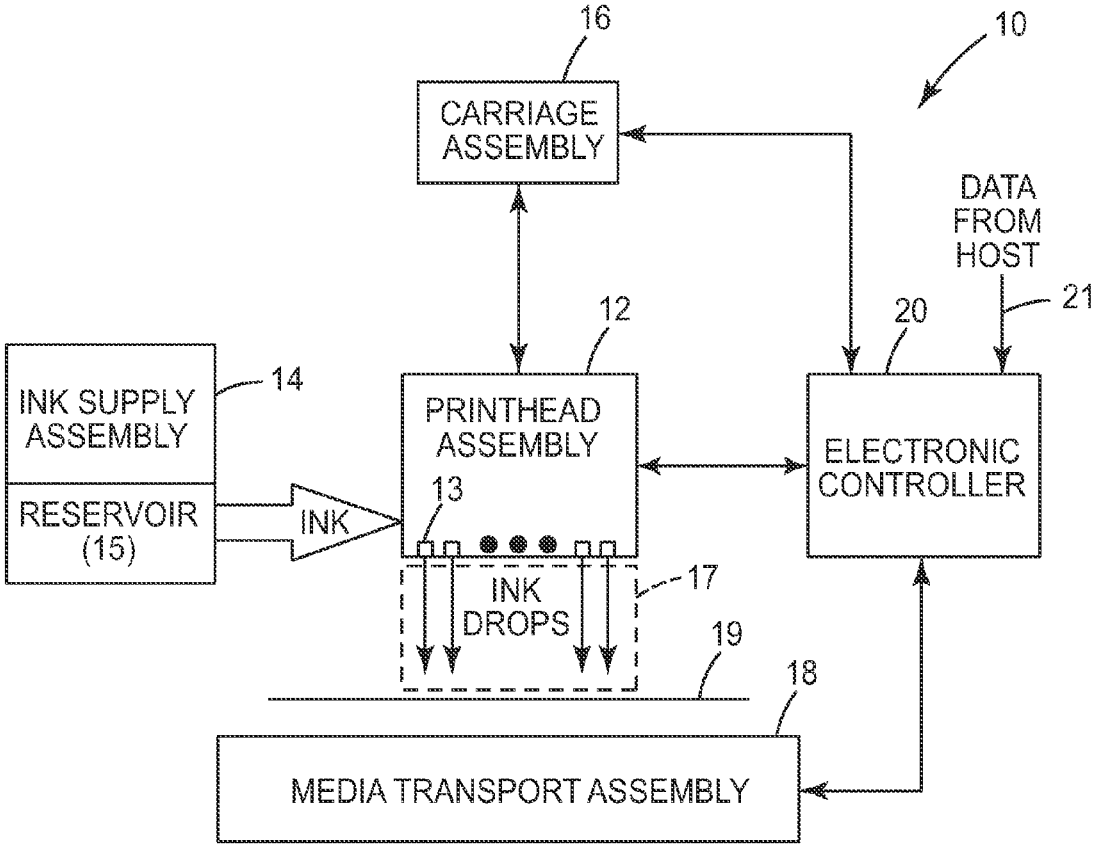
FIG. 1 is a block diagram schematically illustrating a printing system, according to the present general inventive concept.

FIG. 1 illustrates an inkjet printing system 10 in accordance with one embodiment of the present general inventive concept. Inkjet printing system 10 includes an inkjet printhead assembly 12, an ink supply assembly 14, a carriage assembly 16, a media transport assembly 18, and an electronic controller 20. Inkjet printhead assembly 12 includes one or more printheads which eject drops of ink through orifices or nozzles 13 and toward a print media 19 so as to print onto print media 19. Print media 19 is any type of suitable sheet material, such as paper, card stock, envelopes, labels, transparencies, Mylar, and the like. Typically, nozzles 13 are arranged in one or more columns or arrays such that properly sequenced ejection of ink from nozzles 13 causes characters, symbols, and/or other graphics or images to be printed upon print media 19 as inkjet printhead assembly 12 and print media 19 are moved relative to each other.

Ink supply assembly 14 supplies ink to printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together in an inkjet cartridge or pen. In some embodiments, ink supply assembly 14 is separate from inkjet printhead assembly 12 but still directly communicates ink to the printhead assembly 12 via a releasable connection with the ink supply assembly 14 being mounted directly above and at least partially supported by the printhead assembly 12. This embodiment is sometimes referred to as an on-axis configuration of the ink supply assembly 14. However, in other embodiments, the ink supply assembly 14 is positioned remotely from the printhead assembly 12, with the ink supply assembly 14 communicating ink to the printhead assembly 12 via an array of supply tubes. This embodiment is sometimes referred to as an off-axis configuration of the ink supply assembly 14.

Carriage assembly 16 positions inkjet printhead assembly 12 relative to media transport assembly 18 and media transport assembly 18 positions print media 19 relative to inkjet printhead assembly 12. Thus, a print zone 17 is defined adjacent to nozzles 13 in an area between inkjet printhead assembly 12 and print media 19. In one embodiment, inkjet printhead assembly 12 is a non-scanning type printhead assembly. As such, carriage assembly 16 fixes inkjet printhead assembly 12 at a prescribed position relative to media transport assembly 18. Thus, media transport assembly 18 advances or positions print media 19 relative to inkjet printhead assembly 12.

Electronic controller 20 communicates with inkjet printhead assembly 12, media transport assembly 18, and, in one embodiment, carriage assembly 16. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, an image, a document, and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 operates on data 21 to define a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located remotely from inkjet printhead assembly 12.

Figure 2B:
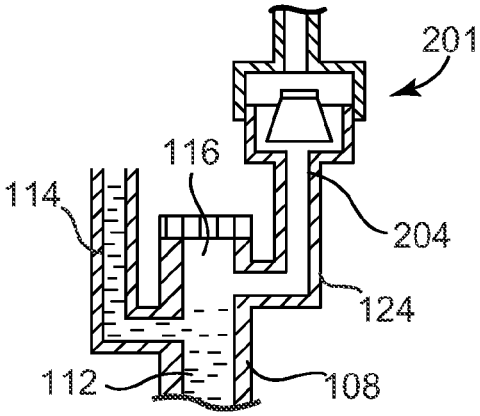
FIG. 2B is an enlarged, partial sectional view of the ink supply system of FIG. 2A, according to the present general inventive concept.
Figure 2A:
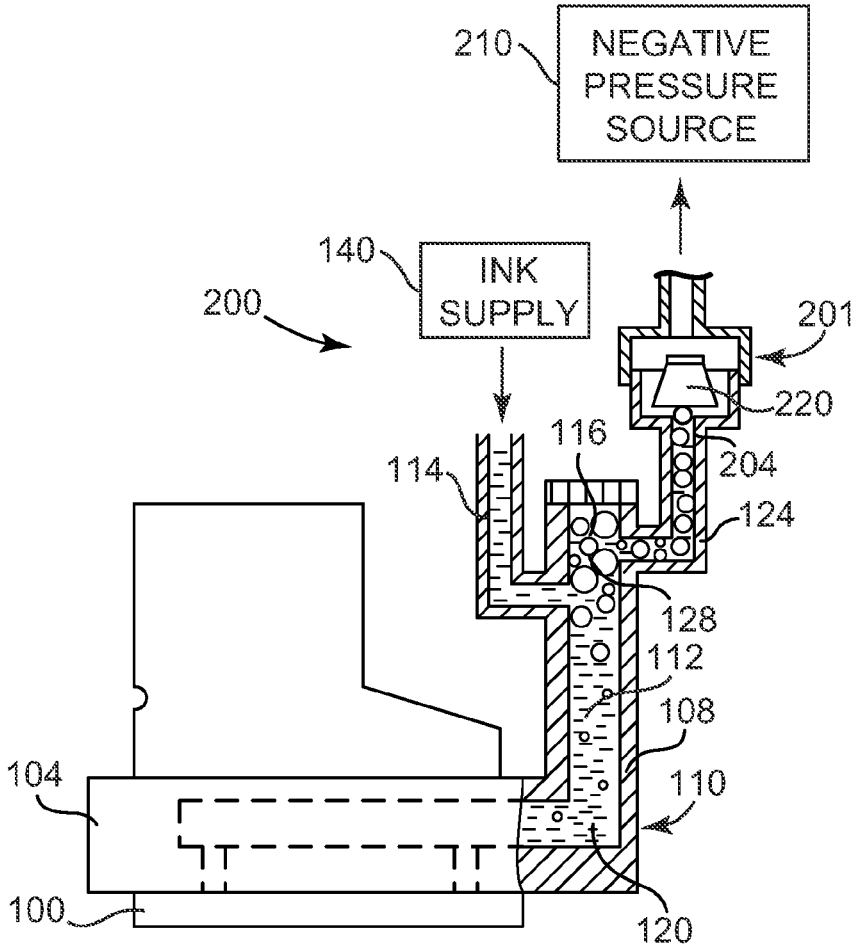
FIG. 2A is a partial sectional view schematically illustrating an ink supply system, according to the present general inventive concept.

FIG. 2A is a partial sectional view schematically illustrating a printing system 200, according to an embodiment of the present general inventive concept. In one embodiment, system 200 comprises at least substantially the same features and attributes of system 10 that was previously described in association with FIG. 1. As shown in FIG. 2A, system 200 includes a printhead 100, support 104, and ink supply system 110. Support 104 provides structural support to position printhead 100 above a media and to enable communication between printhead 100 and ink supply system 110. In one embodiment, ink supply system 110 includes a reservoir 108, conduit 114, ink supply 140, conduit 124, foam regulator 201, and negative pressure source 210. The reservoir 108 is in fluid communication with the printhead 100 via conduit 120 (e.g., ink feed channel) to supply ink 112 to printhead 100, while ink supply 140 is in fluid communication, via conduit 114, with reservoir 108 to supply a free volume of ink 112 to reservoir 108. Moreover, in one embodiment, the reservoir 108 comprises a generally vertical member, with the chamber 205 in communication with the reservoir 108 at a first point (via conduit 124) vertically above a second point at which the first conduit 114 is in communication with the reservoir 108.

As shown in FIG. 2B, an upper portion of the reservoir 108 defines a free space 116 above the free volume of ink 112 and conduit 124 is in communication with free space 116. With this arrangement, negative pressure is applied by negative pressure source 210 through foam regulator 201 and through conduit 124 to act on free volume of ink 112, thereby preventing drooling of ink 112 from printhead 100 despite ongoing supply of ink 112 from ink supply 140 to reservoir 108. Those skilled in the art will understand that FIG. 2B depicts a point in time prior to build up of ink foam that typically occurs during operation of the printing system 200.

With further reference to FIG. 2A, among other factors, the iterative operation of the printhead 100 and the application of negative pressure (via negative pressure source 210) during operation of the printing system 200 contributes to bubble formation, with the air bubbles rising up through the ink 112 within reservoir 108, ultimately resulting in a build up of foam 128 within at least free space 116. As operation of the printing system 200 continues, the ink foam 128 generally fills space 116, progresses into the conduit 124 and into foam regulator 201 where the ink foam 128 engages float member 220 of foam regulator 201.

Because of this foam pathway that coincides with the negative pressure pathway, foam regulator 201 is interposed between reservoir 108 (and printhead 100) and negative pressure source 210. In one aspect, foam regulator 201 is positioned between negative pressure conduit 124 and negative pressure conduit 212. Moreover, to the extent that elements 124 and 212 form part of an overall negative pressure conduit, element 124 corresponds to a first portion of the negative pressure conduit, element 212 corresponds to a second portion of the negative pressure conduit, and foam regulator 201 is interposed between the respective first and second portions of the negative pressure conduit.

Figure 3B:
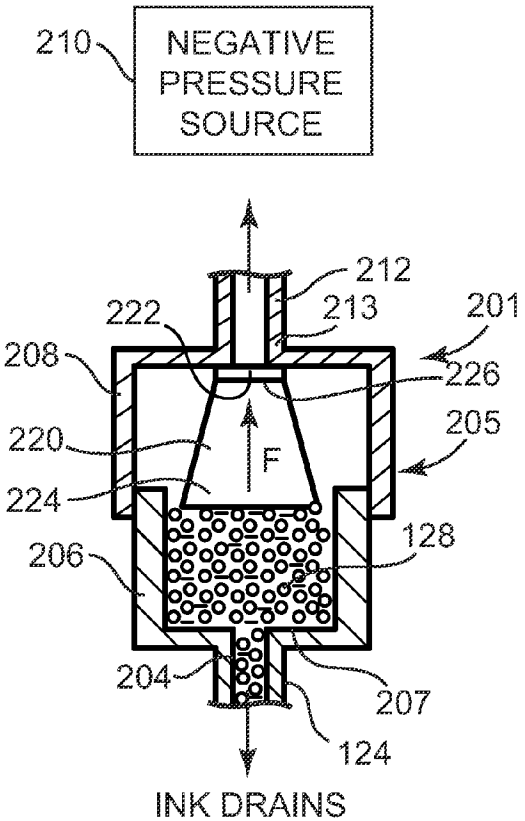
FIG. 3B is an enlarged sectional view of a foam regulator of the ink supply system, according to the present general inventive concept.
Figure 3A:
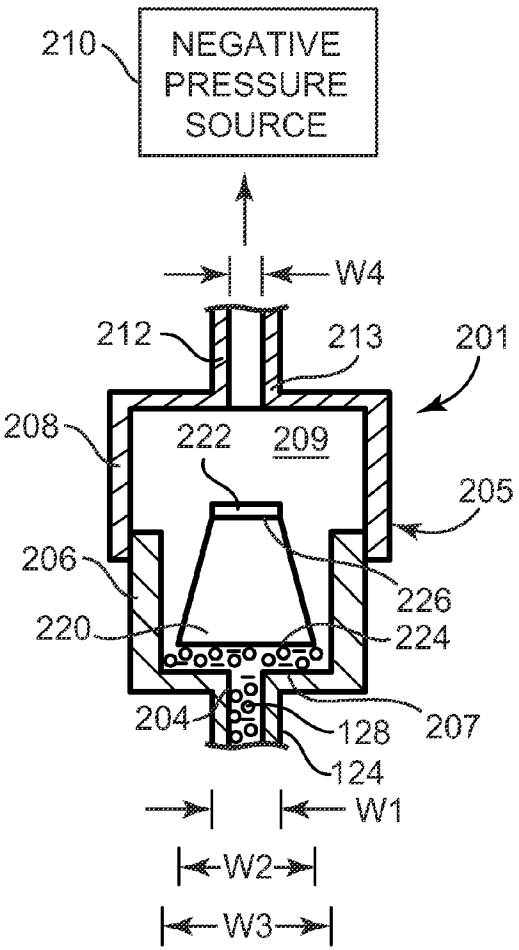
FIG. 3A is an enlarged sectional view of a foam regulator of the ink supply system, according to the present general inventive concept.

FIGS. 3A-3B are enlarged partial sectional views that schematically illustrate operation of foam regulator 201 of ink supply system 110, according to the present general inventive concept. As shown in FIG. 3A, in general terms, foam regulator 201 includes chamber 205 that contains float member 220, which is a buoyant element freely movable within chamber 205. In general terms, float member 220 can be formed of any buoyant material that does not chemically react significantly with ink 112 and/or ink foam 128. In some embodiments, chamber 205 includes a lower portion 206 secured to an upper portion 208 although chamber 205 is constructible in other ways. Prior to operation of printing system 200, the float member 220 rests at the bottom 207 of lower portion 206 of chamber 205 adjacent port 204 of conduit 124. In one aspect, this arrangement corresponds to a first position or open state of float member 220 within chamber 205 that allows negative pressure to be applied to reservoir 108 and printhead 100.

While float member 200 can take a variety of shapes, in one embodiment, float member 220 comprises a generally conical shape with a first end 224 that is substantially wider than a second end 226. In one embodiment, the first end 224 has a width (W2) that substantially matches (or is slightly less than) a width (W3) of lower portion 206 of chamber 205 and that is substantially less than a width (W1) of second end 226 of float member 220.

With this arrangement of float member 220 and chamber 205, the first end 224 of float member 220 covers substantially all of the foam 128 emanating from port 204 of conduit 124. As the amount of ink foam 128 increases and rises within lower portion 206 of chamber 205 over a period of time during operation of the printing system 200, the ink foam 128 buoyantly presses (as represented by directional arrow F) float member 220 upward through chamber 205 until second end 226 of float member 220 contacts and blocks port 213 of conduit 212, as illustrated in FIG. 3B. This arrangement corresponds to a second position or closed state of float member 220 within chamber 205, in which migration of ink foam 128 is stopped and prevented form entering negative pressure conduit 212. Of course, it will be understood that the float member 220 takes numerous positions within chamber 205 between the first position and the second position, depending upon the level of ink foam in chamber 205.

As illustrated by FIG. 3A-3B, port 213 has a width (W4) that is less than a width (W1) of second end 226 of float member 220, which enables float member 220 to completely block access to conduit 212 via port 213.

With this arrangement, float member 220 prevents foam 128 from entering conduit 212, and therefore blocks migration of foam 128 to negative pressure source 210. In addition to protecting negative pressure source 210 from ink foam via blocking conduit 212, this arrangement also temporarily reduces the amount of ink foam. In particular, even with the pathway of negative pressure closed, the ink continues to be pulled out of ink supply 140 (via conduit 114, reservoir 108, etc.) by capillary forces so that the free volume of ink 112 increases, and pressure within reservoir 108 drops. As result, some of the bubbles of ink foam 128 explode while some of the ink (of the ink foam 128) drains from conduit 124 (and chamber 205) back into reservoir 108 and/or ink supply 140.

Ultimately, upon a reduction in the volume of ink foam 128, float member 220 descends within chamber 205, restoring the application of negative pressure on ink 112 in reservoir 108 until an excessive amount of ink foam accumulates again in a volume that causes float member 220 to once again block conduit 212 to negative pressure source 210. It will be understood that the volume of chamber 205 is selectable to control the amount of ink foam permitted to build up before the float member 220 blocks conduit 212.

In some embodiments, float member 220 includes a rubber element 222 (or other resilient member) that creates a seal relative to port 213 of conduit 212 when float member 220 is pressed upward against port 213 by ink foam 128, as illustrated in FIG. 3B. However, in other embodiments, float member 220 omits rubber element 222.

It will be understood that in some embodiments, in addition to incorporating foam regulator 201 as part of ink supply system 110, other measures (e.g. de-foaming agents) are taken to ameliorate a buildup of ink foam in ink supply system 110.

Figure 4:
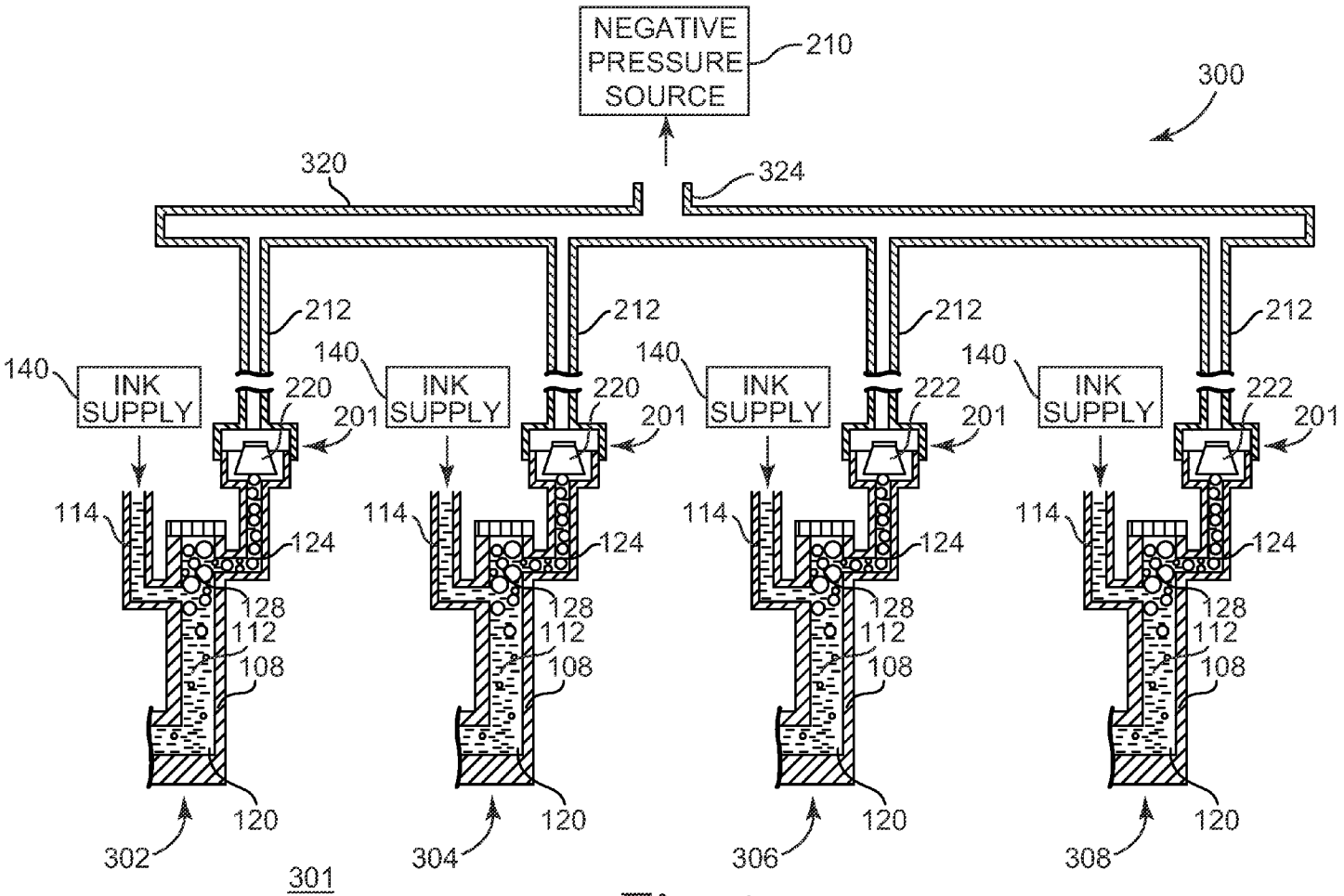
FIG. 4 is a schematic illustration of an array of ink supply systems, according to the present general inventive concept.

FIG. 4 is a sectional view that schematically illustrates an ink supply assembly 300, according to a present general inventive concept. In one embodiment, ink supply assembly 300 includes an array 301 of ink supply systems 302, 304, 306, and 308 with each respective ink supply system 302-308 comprising substantially the same features and attributes as the ink supply system 110 previously described in association with FIGS. 2-3B.

As shown in FIG. 4, ink supply assembly 300 also includes a common conduit 320 in fluid communication with negative pressure source 210 via port 124, the common conduit 320 also being in fluid communication with the negative pressure conduit 212 of each respective ink supply system 302, 304, 306, and 308. In this arrangement, a single or central negative pressure source 210 provides the negative pressure for multiple ink supply systems. Moreover, because each ink supply system 302, 304, 306, 308 includes a foam regulator 201, ink foam 128 built up within one or more of ink supply systems 302, 304, 306, 308 is prevented from migrating into conduits 212 and into common conduit 320. This arrangement ensures that ink foam 128 from one color ink supply system (e.g., one of 302, 304, 306, 308) will not contaminate one of the different colored inks in another ink supply system (one of the other ink supply systems 302, 304, 306, 308) due to an ink foam buildup in common conduit 320 that might otherwise occur in the absence of a foam regulator 201 in each ink supply system 110. In other words, cross-contamination of ink among the respective ink supplies is prevented via a foam regulator 201 of each respective ink supply because the respective foam regulators 201 prevent entry of ink foam from the reservoir of the respective ink supplies into the common conduit that leads to the negative pressure source.

In addition, by preventing entry of the ink foam, the respective foam regulators 201 protect the longevity of the conduit 212 (typically plastic tubing) for each ink supply system 302, 304, 306, 308 from the aggressive chemical characteristics of the ink.

Figure 5:
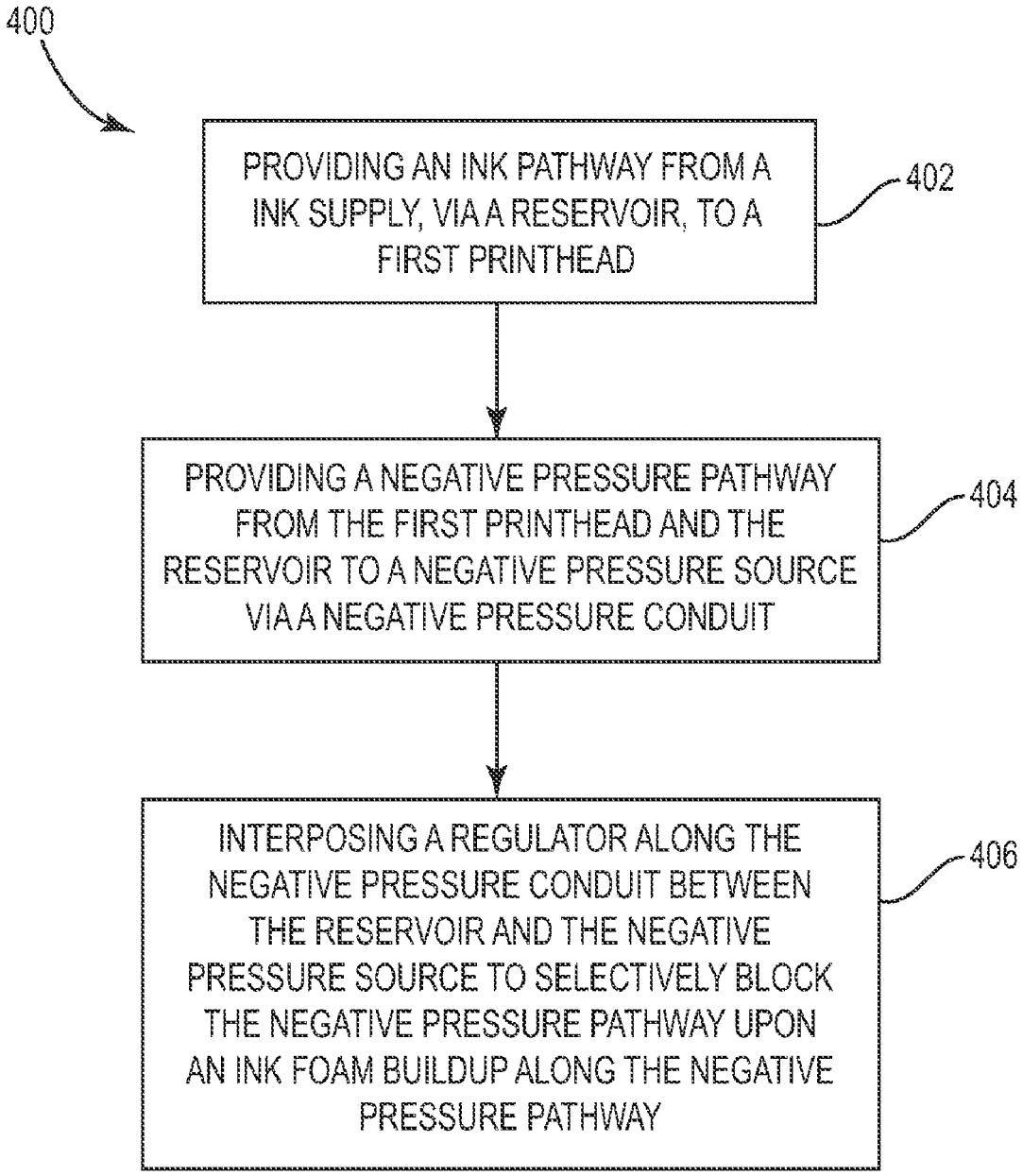
FIG. 5 is a flow diagram schematically illustrating a method of controlling foam in an ink supply system, according to the present general inventive concept.

FIG. 5 is a flow diagram schematically illustrating a method 400 of controlling foam in a printing system, according to one embodiment of the present general inventive concept. In one embodiment, method 400 is performed using the systems and components previously described in association with FIGS. 1-4, while in other embodiments, others systems and components are employed to perform method 400.

As shown in FIG. 5, method 400 comprises providing an ink pathway from an ink supply, via a reservoir, to a first printhead (at box 402). At 404, method 400 includes providing a negative pressure pathway from the first printhead and the reservoir to a negative pressure source via a negative pressure conduit. The negative pressure conduit is independent from the ink pathway. At 406, method 400 includes interposing a regulator along the negative pressure conduit between the reservoir and the negative pressure source to selectively block the negative pressure pathway upon an ink foam buildup along the negative pressure pathway.

In some embodiments, method 400 further includes providing the foam regulator as a chamber that contains a float member that is freely movable within the chamber. A first portion of the chamber is arranged to be in fluid communication with the reservoir via a first portion of the negative pressure conduit (e.g. conduit portion 124) and a second portion of the chamber is arranged to be in fluid communication with a second portion (e.g. conduit portion 212) of the negative pressure conduit. Moreover, in some embodiments, method 400 additionally includes blocking access to the negative pressure conduit via the float member upon ink foam from the reservoir buoyantly pressing the float member upward against a top portion of the chamber and across an opening of the second portion of the negative pressure conduit.

Embodiments of the present general inventive concept neutralizes at least some of the effects of ink foam buildup in a printing system by preventing migration of the ink foam into a negative pressure pathway that is in communication with the ink being supplied to the printhead. In one embodiment, a buoyant element rises in response to the level of ink foam buildup such that the negative pressure pathway is generally maintained for the ink supply system until ink foam rises to a maximum level at which the position of the float member automatically prevented from migrating into the negative pressure source pathway.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An ink supply system comprising:

a reservoir configured to hold a volume of ink and configured to be in fluid communication with a fluid ejection structure; and a foam regulator operable in a first state in which the foam regulator permits application of negative pressure through the foam regulator to apply negative pressure to the fluid ejection structure and to the reservoir, and a second state in which the foam regulator blocks passage of ink foam through the foam regulator, wherein the foam regulator comprises:

a chamber in fluid communication with the reservoir and in fluid communication with a first conduit that is configured to communicate with a negative pressure source; and a buoyant member positioned within the chamber and freely movable, in response to a variable level of ink foam within the chamber, between a first position in which the buoyant member permits application of negative pressure through the chamber in the first state of operation and a second position in which the buoyant member, upon rising in response to a build up of ink foam within the chamber, blocks fluid communication from the chamber into the first conduit in the second state of operation.

2. The ink supply system of claim 1, comprising:

a second conduit in fluid communication with the reservoir and configured to supply ink into the reservoir, the second conduit being independent of the chamber and of the first conduit.

3. The ink supply system of claim 2, wherein the reservoir comprises a generally vertical member and wherein the chamber is in communication with the reservoir at a first point vertically above a second point at which the second conduit is in communication with the reservoir.

4. The ink supply system of claim 1, wherein the buoyant member comprises a first end and a second end, the first end being substantially wider than the second end, and wherein the chamber includes a first portion of the chamber is wider than the first end of the buoyant member to enable negative pressure to fluidly communicate around the buoyant member when the buoyant member is in the first position.

5. An ink supply system comprising:

a reservoir configured to hold a volume of ink and configured to be in fluid communication with a fluid ejection structure;

a foam regulator operable in a first state in which the foam regulator permits application of negative pressure through the foam regulator to apply negative pressure to the fluid ejection structure and to the reservoir, and a second state in which the foam regulator blocks passage of ink foam through the foam regulator, wherein the foam regulator comprises:

a chamber in fluid communication with the reservoir and in fluid communication with a second conduit that is configured to communicate with a negative pressure source, wherein the chamber includes a first portion in communication with the reservoir and configured to accumulate the ink foam emanating from the reservoir; and a buoyant member positioned within the chamber and movable between a first position in which the buoyant member permits application of negative pressure through the chamber in the first state of operation and a second position in which the buoyant member blocks fluid communication from the chamber into the second conduit in the second state of operation, wherein the buoyant member comprises a first end and a second end, the first end being substantially wider than the second end, wherein the first portion of the chamber is wider than the first end of the buoyant member to enable negative pressure to fluidly communicate around the buoyant member when the buoyant member is in the first position.

6. A printhead assembly comprising a printhead structure including a first printhead;

a negative pressure source configured to apply negative pressure to the printhead structure; and an ink supply system including a first ink supply portion that comprises:

a reservoir configured to hold a volume of ink, the reservoir interposed between the printhead structure and the negative pressure source such that the reservoir is in fluid communication with the printhead structure and the negative pressure source; and a foam regulator interposed between the reservoir and the negative pressure source to automatically, selectively block fluid communication from the reservoir to the negative pressure source, wherein the foam regulator of the ink supply portion comprises:

a chamber in fluid communication with the reservoir;

a conduit extending from the chamber and in fluid communication with the chamber, the conduit interposed between the chamber and the negative pressure source; and a buoyant member positioned within the chamber and freely movable between:

a first position in which the buoyant member permits application of negative pressure through the chamber, through the foam reservoir, and on the first printhead; and a second position in which the buoyant member blocks fluid communication of ink foam from the chamber into the conduit, wherein the chamber and the buoyant member are positioned to enable ink foam from the reservoir to enter the chamber and buoyantly urge the buoyant member upward with a rising level of the ink foam into the second position.

7. The printhead assembly of claim 6, wherein the printhead structure includes an array of printheads, including the first printhead, wherein the ink supply system includes an array of ink supply portions, including the first ink supply portion, and wherein a respective one of the printheads is in fluid communication with a respective one of the ink supply portions.

8. The printhead assembly of claim 6, wherein the buoyant member comprises a first end and a second end, the first end being substantially wider than the second end, wherein the chamber includes a first portion in communication with the reservoir and configured to accumulate the ink foam emanating from the reservoir, and wherein the first portion of the chamber is wider than the first end of the buoyant member to enable negative pressure to fluidly communicate around the buoyant member when the buoyant member is in the first position.

9. A printhead assembly comprising:

a printhead structure including an array of printheads, including a first printhead;

a negative pressure source configured to apply negative pressure to the printhead structure;

a common conduit in communication with the negative pressure source;

an ink supply system including an array of ink supply portions and wherein a respective one of the printheads is in fluid communication with a respective one of the ink supply portions, wherein each respective ink supply portion comprises:

a reservoir configured to hold a volume of ink, the reservoir interposed between a respective one of the printheads and the negative pressure source such that the reservoir is in fluid communication with the respective printhead and the negative pressure source;

a foam regulator interposed between the reservoir and the negative pressure source to automatically, selectively block fluid communication from the reservoir to the negative pressure source; and a conduit extending from the foam regulator to be interposed between the foam regulator and the common conduit; and wherein the common conduit is in fluid communication with the conduit of each respective ink supply portion, and wherein each foam regulator of each respective ink supply portion is positioned to prevent fluid communication of ink foam, via the common conduit, from one ink supply portion to another ink supply portion.

10. A method of controlling foam in an ink supply, the method comprising:

providing an ink pathway from a first ink supply, via a reservoir, to a first printhead;

providing a negative pressure pathway from the first printhead and the reservoir to a negative pressure source via a negative pressure conduit, the negative pressure conduit being independent of the ink pathway; and interposing a foam regulator along the negative pressure conduit between the reservoir and the negative pressure source to automatically, selectively block the negative pressure pathway in response to an ink foam buildup along the negative pressure pathway, including:

arranging the foam regulator to include a chamber that contains a float member that is freely movable within the chamber in response to a level of ink foam within the chamber;

arranging a first portion of the chamber to be in fluid communication with the reservoir via a first portion of the negative pressure conduit and arranging a second portion of the chamber to be in fluid communication with a second portion of the negative pressure conduit; and blocking access to the negative pressure conduit via the float member upon the ink foam buoyantly pressing the float member upward against a top portion of the chamber and across an opening of the second portion of the negative pressure conduit.

11. The method of claim 10, comprising:

further defining the ink pathway via an ink supply conduit interposed between the ink supply portion and the reservoir; and maintaining the ink supply conduit to be independent and separate from the negative pressure pathway.

12. The method of claim 10, wherein the float member comprises a first end and a second end, the first end being substantially wider than the second end, wherein arranging the chamber includes:

providing the chamber to include a first portion in communication with the reservoir and configured to accumulate the ink foam emanating from the reservoir, and arranging the first portion of the chamber to be wider than the first end of the float member to enable negative pressure to fluidly communicate around the float member when the buoyant member is not in a blocking position relative to the negative pressure conduit.

* * * * *